US005309570A

United States Patent [19]

Grimm

[11] Patent Number: 5,309,570

[45] Date of Patent: May 10, 1994

[54] KNEE PAD

[75] Inventor: Thomas M. Grimm, Robbinsdale, Minn.

[73] Assignee: Ergodyne Corporation, St. Paul, Minn.

[21] Appl. No.: 97,569

[22] Filed: Jul. 27, 1993

[51] Int. Cl.[5] ..... A41D 13/00

[52] U.S. Cl. ..... 2/24; 2/45; 2/2; 2/267; 2/268

[58] Field of Search ..... 2/24, 23, 20, 22, 44, 2/45, 2, 287, 268; 602/5, 6, 20, 21, 23, 26, 60, 61, 62, 900

[56] References Cited

U.S. PATENT DOCUMENTS

| | | | |
|---|---|---|---|
| 1,372,790 | 3/1921 | Fleet . | |
| 1,449,656 | 3/1923 | Compton . | |
| 1,587,508 | 6/1926 | Coats . | |
| 2,377,339 | 6/1945 | Green . | |
| 2,759,189 | 8/1956 | Cole . | |
| 3,911,497 | 10/1975 | Lewis, Jr. et al. | 2/16 |
| 4,151,614 | 5/1979 | Rhee | 2/24 |
| 4,715,067 | 12/1987 | Beauregard . | |
| 4,893,355 | 1/1990 | Ritter . | |

FOREIGN PATENT DOCUMENTS

| | | | |
|---|---|---|---|
| 413409 | 8/1910 | France | 2/24 |
| 519043 | 3/1940 | United Kingdom | 2/24 |

OTHER PUBLICATIONS

Package from knee pads made by Fabrionics, Inc. and photograph of the product.

*Primary Examiner*—Clifford D. Crowder
*Assistant Examiner*—Gloria Hale
*Attorney, Agent, or Firm*—Merchant, Gould, Smith, Edell, Welter & Schmidt

[57] ABSTRACT

A knee pad includes a base member which, when unassembled, is planar. A top member is operatively connected to the base member. In a preferred embodiment, the top member is also, when unassembled, planar. The base member has first and second points of attachment and, when unassembled, are at a first distance from each other. The top member has first and second points of attachment which, when unassembled, are also a first distance from each other. Provided are means for securing the top member to the base member at the points of attachment wherein, when assembled, the first and second points of attachment of the base member are at a second distance from each other. The second distance is less than the first distance wherein the base member forms a cupped region. Also provided is a means for attaching the base and top members to a user's knee.

17 Claims, 4 Drawing Sheets

FIG. 1
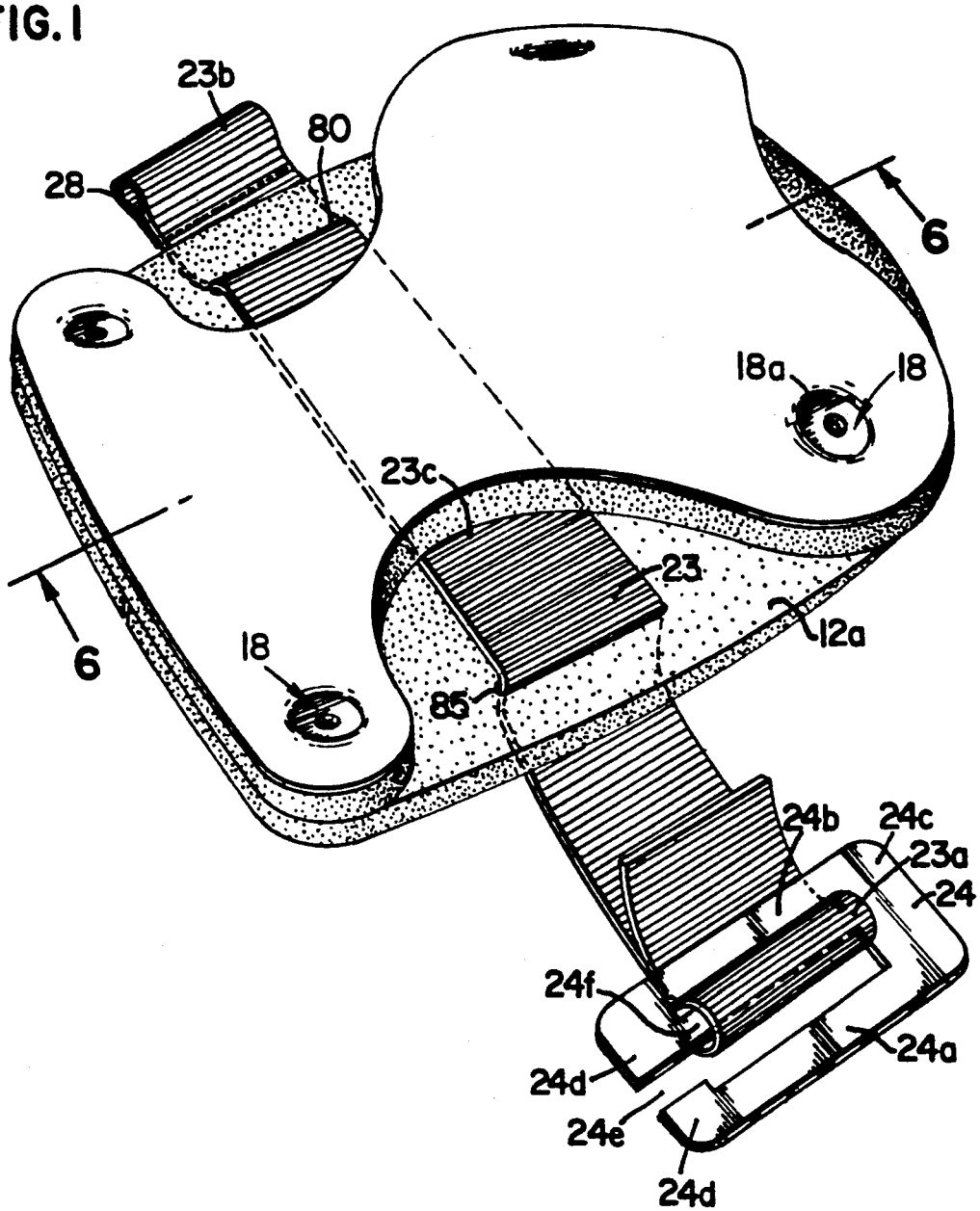
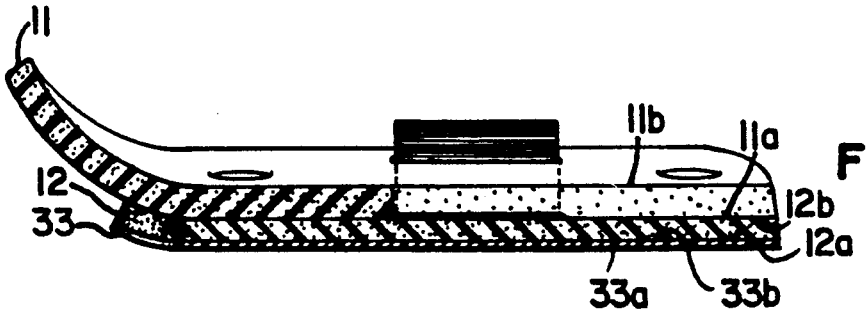
FIG. 6

FIG. 2
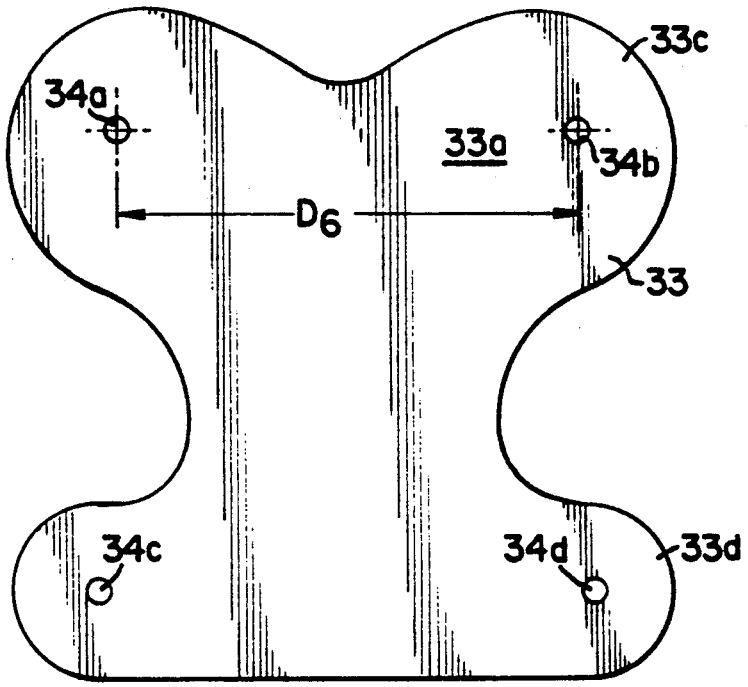
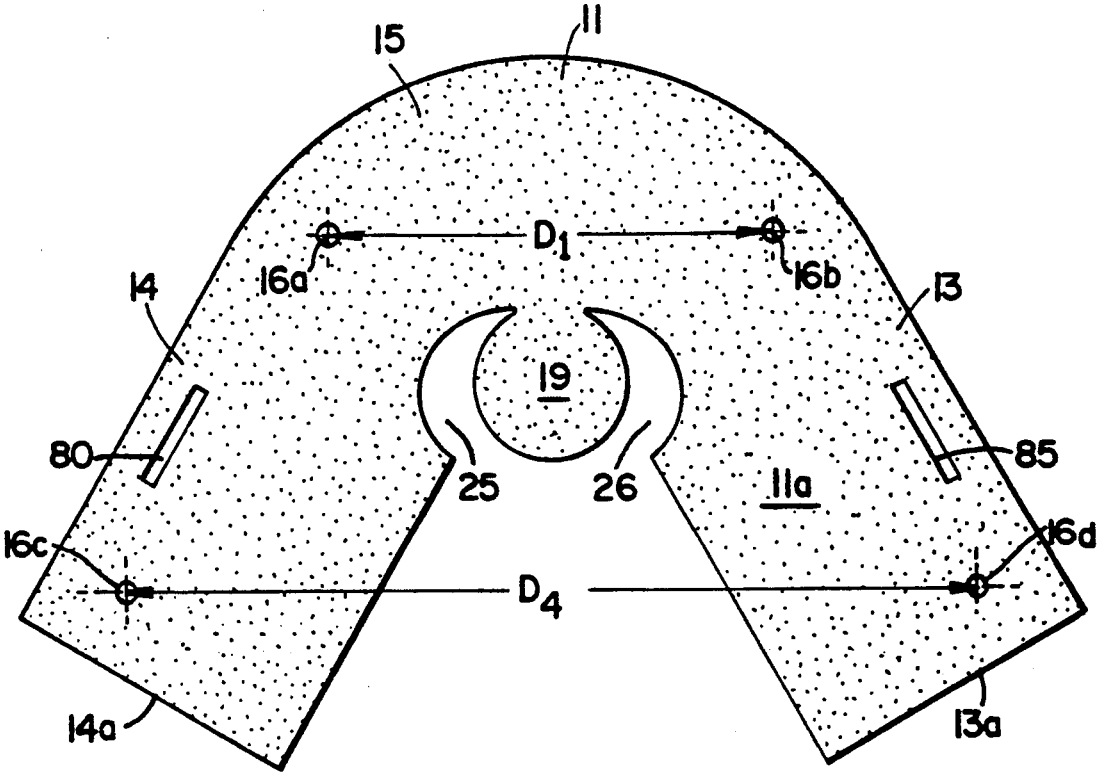
FIG. 3

KNEE PAD

BACKGROUND OF THE INVENTION

1. Field of the Invention

This invention relates generally to knee pads, and more particularly to a knee pad constructed from two planar members.

2. Description of the Prior Art

Knee pads are well known throughout the "protection" world in a variety of configurations. They can have soft shells, hard shells, be made of foam, leather or plastic. The primary function of the knee pad is to provide relief to the bony structure of the knee when in the kneeling position. Like other joints of the body, the knee is void of fatty deposits that would aid in cushioning or protecting this area. When kneeling the majority of a person's body weight is transferred directly to the knee and the comfort level is greatly reduced when kneeling on hard, bumpy or abrasive surfaces. In essence, the knee pad is a "kneeling pad" with the added convenience of a form of attachment to the knee area. Instead of carrying the kneeling pad around with you, the pad travels with you and you don't have to be concerned when changing your position that the pad won't be in the proper position to protect your knee. Many sophisticated knee pads have been developed and they are often quite expensive. One manner of making a lower cost knee pad is to have a foam pad sewn into a fabric pocket. However, sewing is labor intensive and in the end, is expensive and would be prohibitive in producing a value-priced product. Since the majority of the cost of a knee pad was built into the sewn portion of the product, it would be advantageous to eliminate the sewn portion and allocate the majority of the cost on the padding material itself. Assembly time would also be reduced by the elimination of the sewn portions.

Another problem associated with the prior art is the method of attachment of the knee pad to the knee area. Hook and loop closures have both advantages and disadvantages. They enable easy on/off attachment but tend to collect particles and soon loose their ability to fasten. This may pose a problem if the knee pad is used in an environment which is inherently dirty. The knee pad needs easy on and off access when it is used with any regularity, so there needs to be a fastener developed that will address these issues.

Another problem with knee pads is cleanability. Over long periods of time, knee pads may become dirty, which may cause problems when they need to be used on a variety of surfaces, from the garden to laying tile on the floor, or when they become dirty and need to be laundered. It would be ideal to simply rinse off the knee pad and go back to work or simply hang them up until they are needed next.

The present invention addresses the problems associated with the prior art knee pads and provides for a knee pad that is simply to manufacture, eliminating much of the sewing/assembly time as possible, and still protecting the vulnerable regions of the knee. The knee pad is easy to clean, and has an easy on/easy off fastening mechanism.

SUMMARY OF THE INVENTION

The present invention is a knee pad having a base member. The base member has top and bottom surfaces and upper and lower sections. The base, when unassembled, is planar. A top member has top and bottom surfaces and upper and lower sections. The top member is operatively connected to the top surface of the base member. A base member has first and second points of attachment in its upper section. When unassembled, the first and second points are at a first distance from each other. The top member also has first and second points of attachment proximate its upper section. When unassembled, the first and second points of the top member are at a first distance from each other. Also provided is means for securing the top member to the base member at the points of attachment wherein, when assembled, the first second points of attachment of the base member are at a second distance from each other. The second distance is less than the first distance wherein the base member forms a cupped region. Also provided is a means for attaching said base and top members to a user's knee. In a preferred embodiment, the base member includes a first leg member having first and second ends and a second leg member having first and second ends. A midsection member having first and second ends has its first end operatively connected to the first end of the first leg member and its second end is operatively connected to the first end of the second leg member. The first leg member has a first point of attachment and the second leg member has a second point of attachment. When unassembled, the first and second points of attachment of the legs are at a first distance from each other. Also provided is means for securing the top member to the points of attachment of said leg member wherein, when assembled, said points of attachment of the leg member are at a second distance from each other, the second distance less than the first distance, thereby retaining said base member to form the cupped region. In one embodiment the top member is planar.

In addition, two means of attaching the members to the user's knee are provided. The first attaching means includes a strap having first and second ends and a middle section. The middle section is position proximate the base member. Means for releasably connecting the first end of the strap to the second end of the strap by the side of the leg are provided. The connecting means includes an elongate member operatively connected to the first end of the strap, the second end of the strap having an opened loop member. The open ended loop member for sliding on and off the elongate member to secure and release the open ended loop member to the elongate member. The second attaching again comprises a strap having first and second ends and a middle section. A first hook member is operatively connected to the first end and a second hook member is operatively connected to the second end. The hook members each have a hook portion defining a slot. The slot is sized and configured to releasably engage the elongate member thereby releasably securing the knee pad to a user's knee.

Still further, the invention is a method of manufacturing a knee pad. The method includes cutting a base member from a planar material. The base member has top and bottom surfaces and upper and lower sections. The base member has first and second points of attachment proximate its upper section which, when unassembled, the first and second points being at a first distance from each other. A top member is formed. The top member has top and bottom surfaces and upper and lower sections. The top member having first and second points of attachment proximate its upper section which, when unassembled, the first and second points being at a first distance from each other. Next, securing the top member to the base member at the points of attachment wherein when assembled, the first and second points of attachment of the base member are at a second distance from each other. The second distance less than the first distance, wherein the base member forms a cupped region and securing a means for attaching the base and top members, adjacent a user's leg proximate the knee, to the base member.

BRIEF DESCRIPTION OF THE DRAWINGS

FIG. 1 is a perspective view of the knee pad incorporating my present invention.

FIG. 2 is a top plan view of the auxiliary member shown in FIG. 1.

FIG. 3 is a top plan view of the base member shown in FIG. 1.

FIG. 6 is a cross-sectional view of the knee pad shown in FIG. 1, taken generally along the lines 6—6.

DETAILED DESCRIPTION OF THE PREFERRED EMBODIMENT

Figure 4:
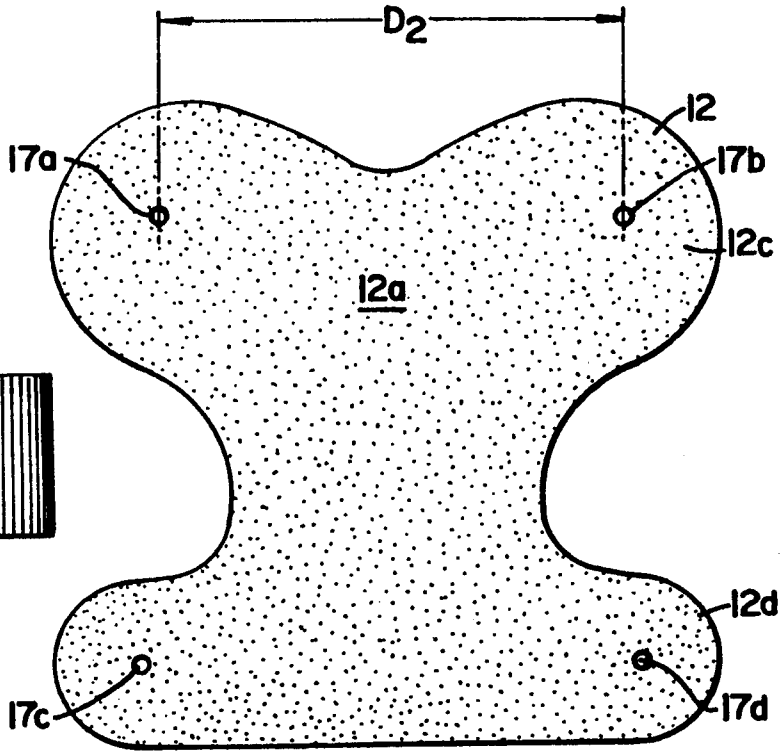
FIG. 4 is a top plan view of the top member shown in FIG. 1.

Referring to the drawings, wherein like numerals represent like parts throughout the several views, there is generally disclosed at 10 a knee pad. The knee pad includes a base member, a top member 12 and, optionally, an auxiliary member 33. The base member 11 has a top surface 11*a*, bottom surface 11*b*, upper section 11*c*, and lower section 11*d*. Similarly, the top member 12 has a top surface 12*a*, bottom surface 12*b*, upper section 12*c* and lower section 12*d*. Similarly, the auxiliary member 33 has a top surface 33*a*, a bottom surface 33*b*, upper section 33*c*, and lower section 33*d*. The members 11 and 12 are preferably made of a closed cell foam material, although, as will be discussed more fully hereafter, other materials may also be utilized. The auxiliary member 33 is preferably constructed from a hard resilient material such as a suitable thermoplastic.

The base member 11 has a first leg 13 operatively connected to a second leg 14 by means of a midsection 15. The legs 13 and 14 are spaced apart from each other and the top member is constructed from a piece of material which, before assembly, is planar. A circular, filler member 19 depends downward from the midsection 15 proximate the intersection of the leg members 13 and 14. Generally arcuate cutout areas 25 and 26 are formed between the filler member 19 and the legs 14 and 13, respectively. As will be described more fully hereafter, the cutout areas 25 and 26 prevent a conical section being formed when the knee pad is assembled and the filler member 19 fills the gap created by the cutout areas 25 and 26. Four openings 16*a*, 16*b*, 16*c* and 16*d* are formed in the base member 11 and are used for points of attachment to the top member 12. Similarly, the top member 12, before assembly, is a planar member. Alternatively, the top member 12 may also be a molded part. The shape of the mold would be similar to that of the assembled base member 11. Four openings 17*a*, 17*b*, 17*c* and 17*d* are formed in the top member 12. The auxiliary member 33 may also be a planar member before assembly, or alternatively may be molded to have a curved shape to match that of the assembled base member 11. The auxiliary member 33 has four openings 34*a*, 34*b*, 34*c* and 34*d*.

Figure 5:
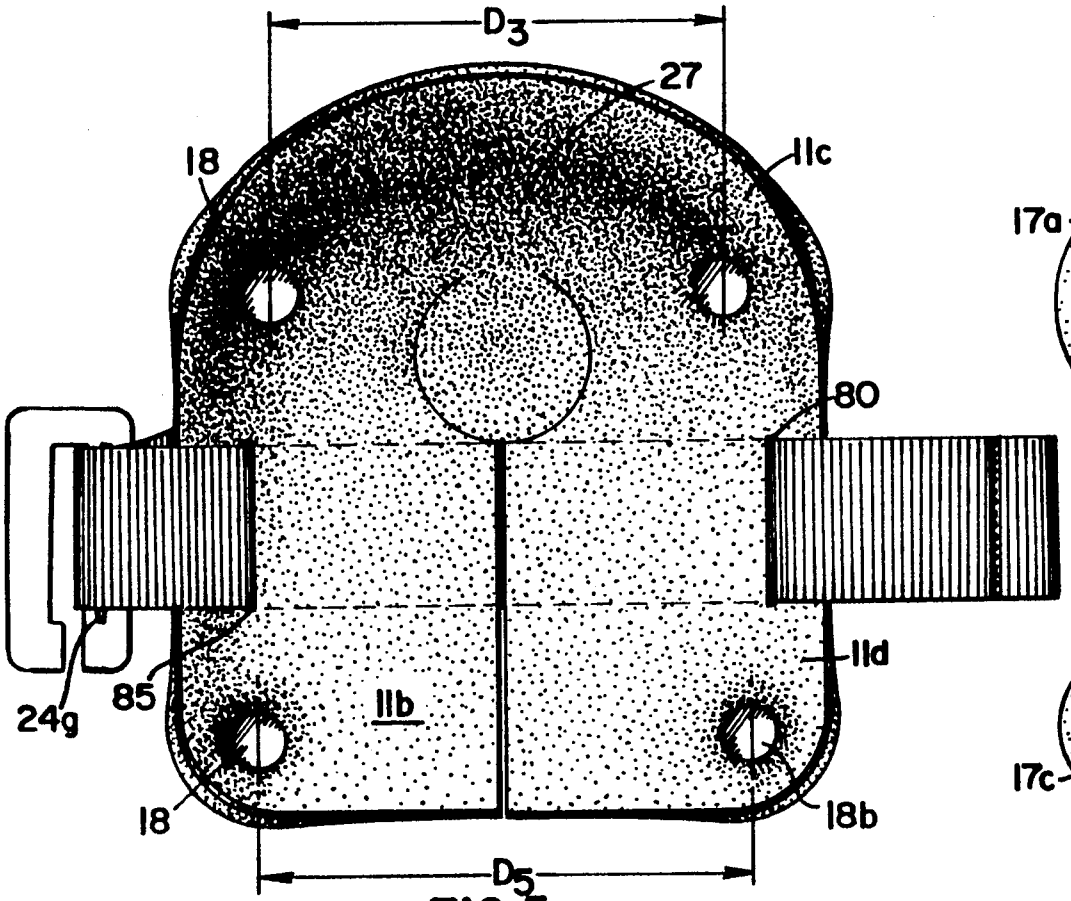
FIG. 5 is a bottom plan view of the knee pad shown in FIG. 1.

FIGS. 2, 3 and 4 show the members 11, 12 and 13 in the unassembled configuration. The distance between openings 16*a* and 16*b* is designated as D1 and the distance between openings 17*a* and 17*b* is designated as D2 and the distance between openings 34*a* and 34*b* is designated as D6. D1, D2 and D6 are approximately equal. The distance between holes 16*c* and 16*d* is designated as D4 and D4 is greater than D1. In assembling the knee pad 10, the legs 13 and 14 are brought proximate each other as shown in FIG. 5. In doing so, this causes the legs to form an angle and no longer be planar. That is, if viewed from a front elevational view, the bottom edges 14*a* and 13*a* form a slight V-shape. In addition, a cup-shaped section 27 is formed proximate the upper section. In use, the cup-shaped section 27 is positioned over the wearer's knee. Then, the bottom surface 12*b* of the top member 12 is placed on the upper surface 11*a* of the base member 11. Next, the bottom surface 33*b* of the auxiliary member 33 is placed on the upper surface 12*a* of the top member 12. Then,. the three members 11, 12 and 33 are secured in position by use of four medical rivets 18 through the openings 16*a–d*, 17*a–d* and 33*a–d*. The medical rivets may be obtained from ITW Nexus, Wooddale, Ill. However, other suitable fastening means may be used such as glue, sonic welding or sewing. In doing so, the distance D3 between the holes 16*a* and 16*b* is at a distance less than D2. This is due to the cup shaped section 27 is curved. The distance between holes 16*a* and 16*b*, measured along the top surface 11*a* would still be the same as D1, but D3 forms a chord of the curved surface.

Similarly, D5, the distance between holes 16*c* and 16*d* when assembled, is less than D4, the distance between holes 16*c* and 16*d* when unassembled. The top member 12 and the rivets 18 hold the base member 11 in tension, thereby retaining the cup shape which is suitable for a knee pad.

It is of course understood that various combinations of the members 11–13 may be utilized in forming a suitable knee pad. For instance, the base member 11 may be constructed from a foam material, as well as the top member 12, and there would not be an auxiliary member 33. In another embodiment, the base member 11 may be foam such as an Eva, or other closed cell material and there need not be a top member 12, just the auxiliary member 33. Alternate materials which may be used for the members include a denser foam, leather, a molded plastic, rubber or vinyl. The foam could also be covered in a fabric which is sewn or laminated to the surface to enhance the properties of the knee pad for other specific applications.

The base member 11 has a midsection which has a curved top surface and the legs are at approximately a 60° angle although other suitable angles may be used. It is understood that other suitable configurations may also be utilized. In the configuration shown, wherein the legs are at approximately a 60° angle, if there was no circular member 19 and no cutouts 25 and 26, a conical point would be formed when the legs were brought together in their assembled condition. Therefore, cutouts 25 and 26 are utilized so as to prevent the conical section from being formed. The circular filler section 19 is then used to fill the gap formed by the cutout sections 25 and 26.

It is then necessary to provide a means for attaching the assembled base and top member to the user's knee.

Two embodiments of an attaching means are shown in the drawings. The first strap in shown in FIGS. 1, 5 and 6 and the second embodiment is shown in FIG. 7.

Referring to FIGS. 1, 5 and 6, there is a strap 23 having a first end 23*a* and a second end 23*b* and a middle section 23*c*. Preferably, the strap 23 is a one-piece strap. At the second end 23*b*, a loop 28 is formed and the loop 28 forms a bore or opening which extends throughout the width of the strap 23. The strap is positioned between the top member 12 and the base member 11. The first end 23*a* is inserted through a slit 80 in the base member 11 and the second end 23*b* is inserted through a slit 85 in the base member. A buckle 24 is operatively connected to the second end 23*b* of the strap 23. The buckle 24 has a generally rectangular outer perimeter comprising sides 24*a* and 24*b*, operatively connected to a top member 24*c*. The bottom member 24*d* is operatively connected to the sides 24*a* and 24*b* and has an opening 24*e* formed by a split in the bottom member 24*d*. An intermediate member 24*f* is operatively connected between the bottom 24*d* and top 24*c* and is generally parallel to the side 24*d*. The intermediate member 24*f* and side 24*b* form an aperture 24*g*. As viewed in FIG. 1, the second end 23*b* of the strap is placed under the buckle and then looped over the intermediate member 24*f* and through the aperture 24*g*. The length of strap 23*f* can then simply be adjusted by pulling more or less of the second end 24*b* through the aperture 24*g*. To attach the knee pad to the user's knee, the knee pad is simply placed on the user and the strap ends 23*a* and 23*b* are positioned around the back of the user's knee, and fastened off to the side of the leg, next to the knee. The second end 23*b* is fastened to the first end 23*a* by simply slipping the side member 24*a* through the loop 28. This allows for the strap to be easily slid on and off the side member 24*a* to secure and release the loop to the side member.

Figure 7:
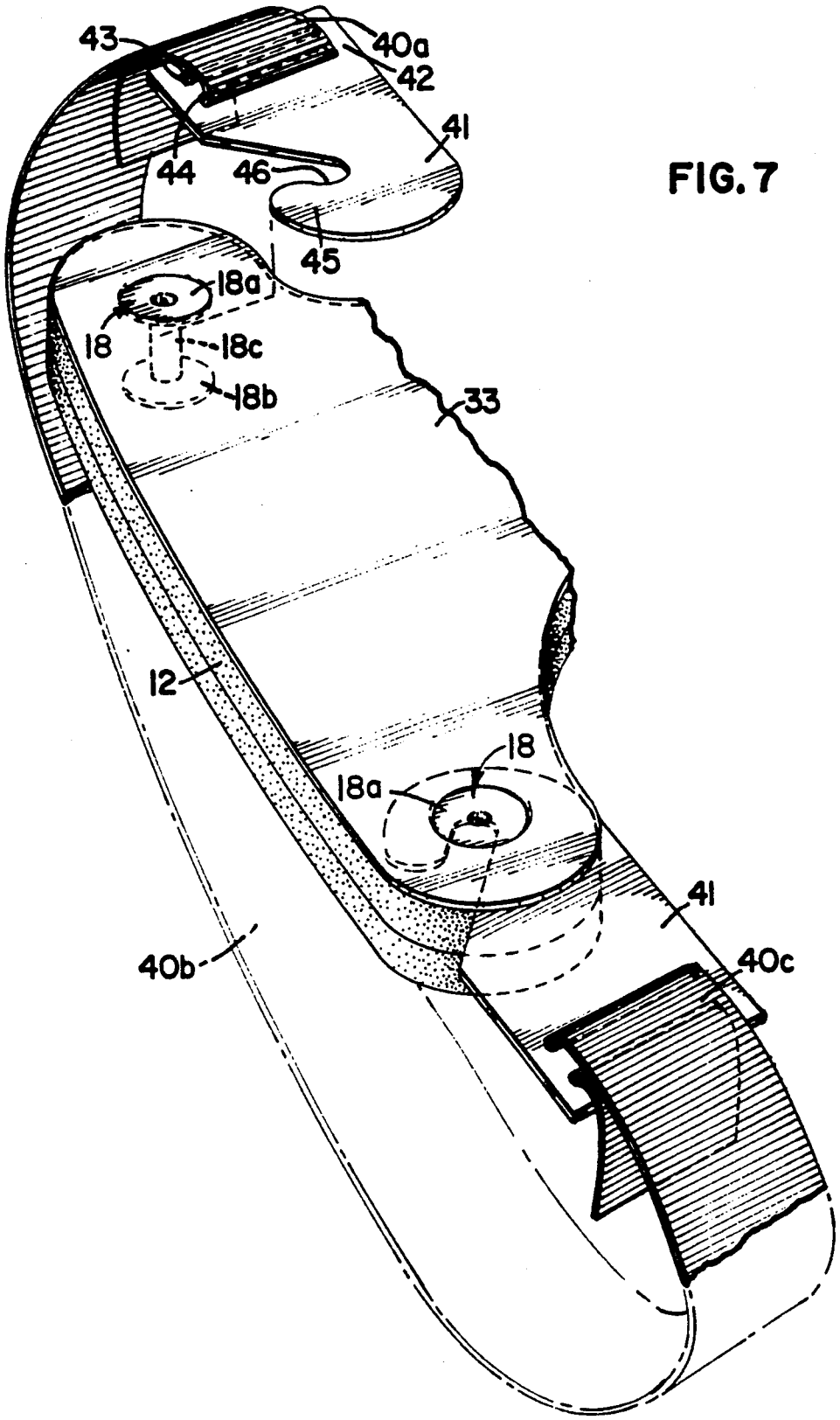
FIG. 7 is a perspective view of a second embodiment of the present invention using a second attachment.

An alternative embodiment of the attaching means is shown in FIG. 7. The attaching means includes a strap 40 having a first end 40*a*, second end 40*b*, and middle section 40*c*. A hook member 41 is attached to the first end 40*a* and another hook member 41 is attached to the second end 40*b*. The hook 41 has a base 42 having two elongate slots 43 and 44. The first end 40*a* of the strap 40 is inserted over the top of the base 42 and through the second slot 44. Then, the strap continues underneath the base 42 and up through the slot 43 to thereby fasten the first end 40*a* to the hook member 41. Again, the adjustment of the length of the strap may be accomplished by simply pulling the first end 40 a through the slots 43 and 44. The hook member includes a hook portion 45 and is operatively connected to the base portion 44. Preferably, this is a single piece plastic hook member. The hook portion 45 defines a slot 46. To fasten the hook member 41 to the knee pad, the hook member 41 is inserted between the auxiliary member 33 and the top member 12. The rivet 18 has a top head 18*a* connected to a bottom portion 18*b* by means of a elongate member 18*c*. The slot 46 is sized and configured to releasably engage the elongate member 18*c*. As shown in FIG. 7, the slot engages the elongate member 18*c* and thereby holds the hook member 41 in position and thereby the strap 40 in position. While FIG. 7 shows only one strap being utilized, it is understood that a second strap could also be utilized around the third and fourth rivets.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

I claim:

1. A knee pad comprising;

(a) a base member having top and bottom surfaces and upper and lower sections, which when unassembled is planar;

(b) a top member having top and bottom surfaces and upper and lower sections operatively connected to the top surface of said base member;

(c) said base member having first and second points of attachments proximate its upper section, when unassembled said first and second points being at a first distance from each other;

(d) said top member having first and second points of attachments proximate its upper section, when unassembled said first and second points being at a first distance from each other;

(e) means for securing said top member to said base member at said points of attachment wherein, when assembled, said first and second points of attachment of said base member are at a second distance from each other, said second distance less than said first distance wherein said base member forms a cupped region; and (f) means for attaching said base and top members to a user's knee.

2. The knee pad of claim 1, wherein said top member, when unassembled is planar.

3. The knee pad of claim 1, wherein said base member comprises;

(a) a first leg member having first and second ends;

(b) a second leg member having first and second ends;

(c) a midsection member having first and second ends, said first end of said first leg member operatively connected to said first end of said midsection member and said first end of said second leg member operatively connected to said second end of said midsection member;

(d) said first leg having a first point of attachment and said second leg having a second point of attachment, when unassembled said first and second points of attachment of said legs being at a first distance from each other;

(e) means for securing said top member to said points of attachment of said leg members wherein, when assembled, said points of attachment of said leg members are at a second distance from each other, said second distance less than said first distance thereby retaining said base member to form said cupped region.

4. The knee pad of claim 1, wherein said base member is foam.

5. The knee pad of claim 1, wherein said top member is foam.

6. The knee pad of claim 1, wherein said top member is a hard, resilient material.

7. The knee pad of claim 6, wherein said hard material is a plastic.

8. The knee pad of claim 1, further comprising an auxiliary member operatively connected to said top member said auxiliary member is a hard resilient material.

9. The knee pad of claim 1, wherein said base member is die cut from a foam material.

10. The knee pad of claim 1, wherein said top member is die cut from a foam material.

11. The knee pad of claim 1, wherein said attaching means comprises;

(a) a strap having first and second ends and a middle section;

(b) said middle section positioned proximate said base member; and (c) means for releasably connecting said first end of said strap to said second end of said strap behind a user's knee, said connecting means comprises;

(i) an elongate member operatively connected to said first end of said strap;

(ii) said second end of said strap having an open ended loop member, said open ended loop member for sliding on and off said elongate member to secure and release said open ended loop member to said elongate member.

12. The knee pad of claim 1, wherein said securing means has first and second elongate members between said bottom and top members.

13. The knee pad of claim 12, wherein said securing means is a rivet.

14. The knee pad of claim 12, wherein said attaching means comprises;

(a) a strap having first and second ends and a middle section;

(b) a first hook member operatively attached to said first end and a second hook member operatively attached to said second end; and (c) said hook members each having a hook portion defining a slot, said slot sized and configured to releasably engage said elongate member, thereby releasably securing said knee pad to a user's knee.

15. The knee pad of claim 3, wherein where said leg members are operatively connected to said midsection, cutout areas are defined, wherein said cutout areas prevent a conical section being formed when said knee pad is assembled.

16. The knee pad of claim 15, further comprising a filler member operatively connected to said midsection and positioned between said cutout areas, wherein when assembled, said filler member fills a gap created by said cutout areas.

17. A knee pad comprising;

(a) a base member, die cut from a foam material, having top and bottom surfaces and upper and lower sections, which when unassembled is planar;

(b) a top member having top and bottom surfaces and upper and lower sections operatively connected to the top surface of said base member, said top member, when unassembled is planar;

(c) said base member having first and second points of attachments proximate its upper section, when unassembled said first and second points being at a first distance from each other, wherein said base member comprises;

(i) a first leg member having first and second ends;

(ii) a second leg member having first and second ends;

(iii) a midsection member having first and second ends, said first end of said first leg member operatively connected to said first end of said midsection member and said first end of said second leg member operatively connected to said second end of said midsection member;

(iv) said first leg having a first point of attachment and said second leg having a second point of attachment, when unassembled said first and second points of attachment of said legs being at a first distance from each other; and (v) means for securing said top member to said points of attachment of said leg members, wherein, when assembled said points of attachment of said leg members are at a second distance from each other, said second distance less than said first distance thereby retaining said base member to form said cup region;

(d) said top member having first and second points of attachments proximate its upper section, when unassembled said first and second points being at a first distance from each other;

(e) means for securing said top member to said base member at said points of attachment wherein, when assembled, said first and second points of attachment of said base member are at a second distance from each other, said second distance less than said first distance wherein said base member forms a cupped region; and (f) means for attaching said base and top members to a user's knee.

* * * * *